US006539765B2

(12) United States Patent
Gates

(10) Patent No.: US 6,539,765 B2
(45) Date of Patent: Apr. 1, 2003

(54) ROTARY FORGING AND QUENCHING APPARATUS AND METHOD

(76) Inventor: Gary Gates, 19 Town View Cir., Platte City, MO (US) 64079

( * ) Notice: Subject to any disclaimer, the term of this patent is extended or adjusted under 35 U.S.C. 154(b) by 7 days.

(21) Appl. No.: 09/818,474

(22) Filed: Mar. 28, 2001

(65) Prior Publication Data

US 2002/0139161 A1 Oct. 3, 2002

(51) Int. Cl.[7] ..... B21B 27/06

(52) U.S. Cl. ..... 72/69; 72/85; 72/342.5; 72/364; 148/654; 29/894.325

(58) Field of Search ..... 72/69, 82.85, 342.1, 72/342.2, 342.3, 342.5, 342.6, 364; 148/646, 647, 654, 660; 266/117, 259; 29/894.325

(56) References Cited

U.S. PATENT DOCUMENTS

| | | | | |
|---|---|---|---|---|
| 2,535,110 A | | 12/1950 | Wishart | 148/21.55 |
| 2,736,674 A | | 2/1956 | Harmon | 148/12.7 |
| 3,674,247 A | | 7/1972 | Gillick | 266/4 E |
| 4,000,634 A | * | 1/1977 | Hixson | 72/69 |
| 4,528,734 A | | 7/1985 | Beyer | 29/159.01 |
| 4,579,604 A | | 4/1986 | Beyer | 148/12.7 A |
| 4,687,524 A | | 8/1987 | Berg | 148/11.5 |
| 4,899,570 A | | 2/1990 | Mills et al. | 72/364 |
| 4,900,376 A | | 2/1990 | Von Hagen et al. | 148/153 |
| 4,936,129 A | | 6/1990 | Lipper et al. | 72/68 |
| 5,092,040 A | | 3/1992 | Kato et al. | 29/894.324 |
| 5,277,717 A | | 1/1994 | LaSalle et al. | 148/550 |
| 5,409,555 A | | 4/1995 | Fujita et al. | 148/667 |
| 5,531,088 A | | 7/1996 | Inatani | 72/84 |
| 5,740,609 A | | 4/1998 | Jurus | 29/894.324 |
| 6,030,471 A | | 2/2000 | Coles et al. | 148/583 |
| 6,185,978 B1 | * | 2/2001 | Sundgren et al. | 72/364 |
| 6,328,829 B1 | * | 12/2001 | Kato et al. | 148/647 |

FOREIGN PATENT DOCUMENTS

| | | | | |
|---|---|---|---|---|
| SU | 554045 | * | 4/1977 | 72/69 |
| SU | 616015 | * | 7/1978 | 72/69 |
| SU | 1489899 | * | 6/1989 | 72/69 |
| WO | WO 91/06384 | * | 5/1991 | 72/69 |

OTHER PUBLICATIONS

SMS Eumuco GmbH Advantages of Aluminum Wheels produced by Axial Closed–die forming.
Cincinnati Hydrospin Computer numerical controlled spin forming machine Hydro–Tech Company.

* cited by examiner

*Primary Examiner*—Ed Tolan
(74) *Attorney, Agent, or Firm*—Wm. Bruce Day

(57) ABSTRACT

A rotary forging and quenching apparatus and method forms and rapidly cools an axial-symmetric object from a spin formable material. The process uses a preheated billet which is clamped between opposed fixture mandrels which have a circumferential die shape and with quench solution channels running through the fixtures. The mandrels are spun and at least one contour roller of a mating circumferential die shape is brought into bearing contact against the billet in order to spin-form the material into the desired die shape. The mandrel and peripheral margin of the spinning billet are flooded with a quench solution coolant while being spin formed. This process streamlines the manufacturing of wheels or other axial-symmetric parts like cylinders, hemispheres, cones, etc. Typically, parts that require heat treatment, like aluminum alloys, will benefit from this process. The process minimizes the distortion encountered in heat treatment and eliminates the need to add extra material to ensure final dimensions. This reduces material, machining and manufacturing costs.

5 Claims, 6 Drawing Sheets

ROTARY FORGING AND QUENCHING APPARATUS AND METHOD

FIELD OF THE INVENTION

The present invention relates generally to the formation of spin formable objects, such as vehicle wheels and other axial-symmetric parts, and more particularly to an improved method and apparatus for forming such a vehicle wheel or part while simultaneously heat treating the material.

BACKGROUND OF THE INVENTION

Vehicle wheels may be conventional welded steel wheels or they may be formed as a one-piece wheel from a lightweight alloy, such as aluminum. These aluminum wheels are lighter than conventional welded steel wheels and reduce unsprung weight for better vehicle handling, as well as reduce weight for improved fuel efficiency. One-piece vehicle wheels of aluminum can be formed in a variety of different designs, allowing the customer to customize the look of his car or motorcycle. Automotive original equipment manufacturers (OEM) sales and after market sales in one-piece aluminum vehicle wheels are significant and the look of such wheels is considered desirable to a broad spectrum of the motoring public.

In a typical manufacturing operation, such as described in U.S. Pat. No. 4,528,734, a cast log or solid cylindrical length of aluminum is provided from a metals supplier and from which a several inch thick cylindrical billet is severed, which is then subjected to a series of hot forging operations to form the wheel center and a pair of rim flange legs. Thereafter, the forging is subjected to a trimming operation. The forged and trim wheel blank is then rough formed by a pair of spinning rollers which operate to axially elongate one of the rim flange legs and selectively vary the cross-sectional thickness of the flange legs. The rough form wheel is then subjected to a first solution heat treatment, after which final contouring and shaping is performed by additional spinning rollers. Finally, suitable machining cutters are used to face and machine to final tolerances the mounting surface portion of the wheel center, bead rim and other wheel parts prior to placing the wheel into service. Upon final contouring of the wheel, final machining of valve and bolt holes is done, followed by suitable appearance finishing and a final heat treating to provide a finished one-piece vehicle wheel. Heat treatment of aluminum is required to achieve the strength necessary for most lightweight aluminum parts. This requires the part, depending on the specific aluminum alloy, to be heated to 840 to 1075° F., rapidly quenched in cold water and reheated to 240 to 400° F. This thermal process strengthens the aluminum, but because of the severe thermal cycle and thermal shock, considerable distortion of the part occurs. Because the high temperature heat cycle is near the melting point of aluminum, the metal is soft and weak. The weight of the part at this high temperature causes the part to sag. This sagging distortion is increased considerably by the unequal thermal contraction of the wheel as it enters a cold water quench.

Several processes have been tried to minimize heat treatment distortion. These include:

1. Elaborate fixtures to hold the part rigid during the heating and quenching cycles.

2. Reducing the temperature gradient to lower the severity extremes of the quench. This is accomplished by chemical additions to the water bath to slow the cooling rate, raising the quench bath temperature to reduce the thermal difference or spray-quenching to reduce the cooling rate and thermal shock.
3. Mechanically stretching to straighten the part. This straightens the part and equalizes residual stress to lower distortion which must be machined out.

These procedures help minimize distortion from heat treatment, but in many cases, are not economical when compared to simply creating a thicker part to minimize distortion and then machining off the additional material.

Prior to the present invention, the inventor has produced a one-piece forged aluminum wheel from 6061-T6 alloy/temper which consists of starting with a cast aluminum billet log, 6 to 12 inches in diameter and 20 feet long. These logs are cut into a short length required to produce a billet. The cut piece is preheated to 800 to 1000° F. and press-forged into the shape required for spinning. This forged shape is placed up on a spinning machine and spun at room temperature. This forms a wheel of rough dimensions with extra metal on all surfaces to allow final machining of the finished wheel. After spinning, the rough-formed wheel is placed into a heat treat furnace and solution treated at 960 to 1075° F., followed by a rapid quench into water. This high temperature cycle and rapid quench causes wheel distortion. This requires extra metal on most wheel surfaces to guarantee the wheel can be machined to the required dimensions and tolerances.

Variations on the above process are disclosed in U.S. Pat. Nos. 4,936,129, 4,637,112, 4,532,786 and UK 2063722A. All of these patents disclose forming the wheel on a spinning machine wherein forming is done at room temperature using single-point contact radius rotors. Heat treatment is accomplished subsequent to spinning. Another technique is disclosed in U.S. Pat. Nos. 4,579,604 and 4,528,734 and involves spinning on a computer numerically controlled (CNC) machine. In this process, the wheel is spun with radius rollers on a mandrel after quenching and prior to a subsequent 350° F. aging process. This forming operation removes distortion from the quenching and sizes the wheel to the mandrel, setting in the wheel the required dimensions and tolerances. The forming rollers are in point contact with the billet material and form the material at a rate that is much slower than that of a full contour roller used in the inventor's following described rotary quenching process. The amount of metal reduction in this intermediate heat treatment process is limited to approximately a 50% reduction in wall thickness.

BRIEF DESCRIPTION OF THE INVENTION

A rotary forging and quenching apparatus and method minimizes heat treatment distortion. This process requires forming during the normal heat treat quenching cycle. Rotary forging and quenching is a new process which combines the standard heat treatment process, rotary forging and CNC spin forming. Parts subjected to this process receive a first stage of heat treatment in a preheat furnace prior to the inventor's process. These parts are rapidly transferred to the rotary forging and quenching machine, and formed and cooled during the quenching phase of a standard heat treatment process. The rotary forging and quenching machine is built similarly to a CNC spinning machine with critical modifications to accelerate the forming operation to coincide with the short time necessary for quenching. These changes require increased slide/roller forces, rapid slide/roller motion, full contour rollers, special high force part fixtures, rapid part fixture clamping, cooled machine bearings and CNC controlled part coolant. The rapid high force roller slide motion, rapid high force part clamping and full contact forming rollers are essential to accomplish the forming operation in the short time required to quench the metal. Rapid slide motion assures the slides are in position and that forming is accomplished during the cooling phase of the heat treatment process. Full contact rollers are necessary to form the final contact quickly. High force rollers and tailstock clamping are required to handle the forces required by full contact rollers.

Special part clamping fixtures are designed to clamp the part to minimize distortion, provide an inside rim contour support for the forming rollers and direct coolant to the rim center. Under the disclosed process, an aluminum part, such as of 6061 alloy aluminum, is preheated to the solution treatment temperature of 960–1075° F. The part is rapidly transferred and clamped in a special rotary quench headstock fixture. This tooling is designed to promote sequential cooling of the part wherein the inside of the fixture directs coolant on the wheel center, cooling the center as the fixture is started rotating. Full contact rollers, such as one, two or multiple rollers, rapidly form the hot periphery of the part into the wheel rim contour. As the metal is formed to the rim contour, the cool fixture and coolant sprayed on the exterior rapidly cool the rim to complete the rotary forging and quenching process. Because this forming and quenching process is done on a mandrel fixture, it nearly eliminates the quench distortion that is exhibited by the standard heat treatment process. The center of the wheel is constrained during the cooling process and as a result, internal stresses within the wheel center are believed to improve the fatigue life of the wheel. Hot forming the rim portion with full contact rollers allows the rim material to be moved faster, further and with less roller force than could be accomplished at room temperature.

This rapid CNC-controlled sequential cooling and forming operation produces an effective heat treat quenching process, eliminates heat treat distortion and allows parts to be produced nearer to final dimensions while producing a beneficial stress condition in the finished part. The center is cooled first, before the outer, which places the center into a compressive stressed condition at room temperature. Wheels produced with a similar stress condition were reported by U.S. Pat. No. 4,767,473 to improve a wheel's fatigue properties. The process results in lower material and machining cost and produces a longer lasting, high quality wheel.

One of the first applications for this process is the production of 6061-T6 aluminum wheels. However, this process is applicable to many round parts of aluminum alloy that require a solution treatment, quench and aging heat treatment process.

DESCRIPTION OF THE PREFERRED AND ALTERNATE EMBODIMENTS

Figure 1:
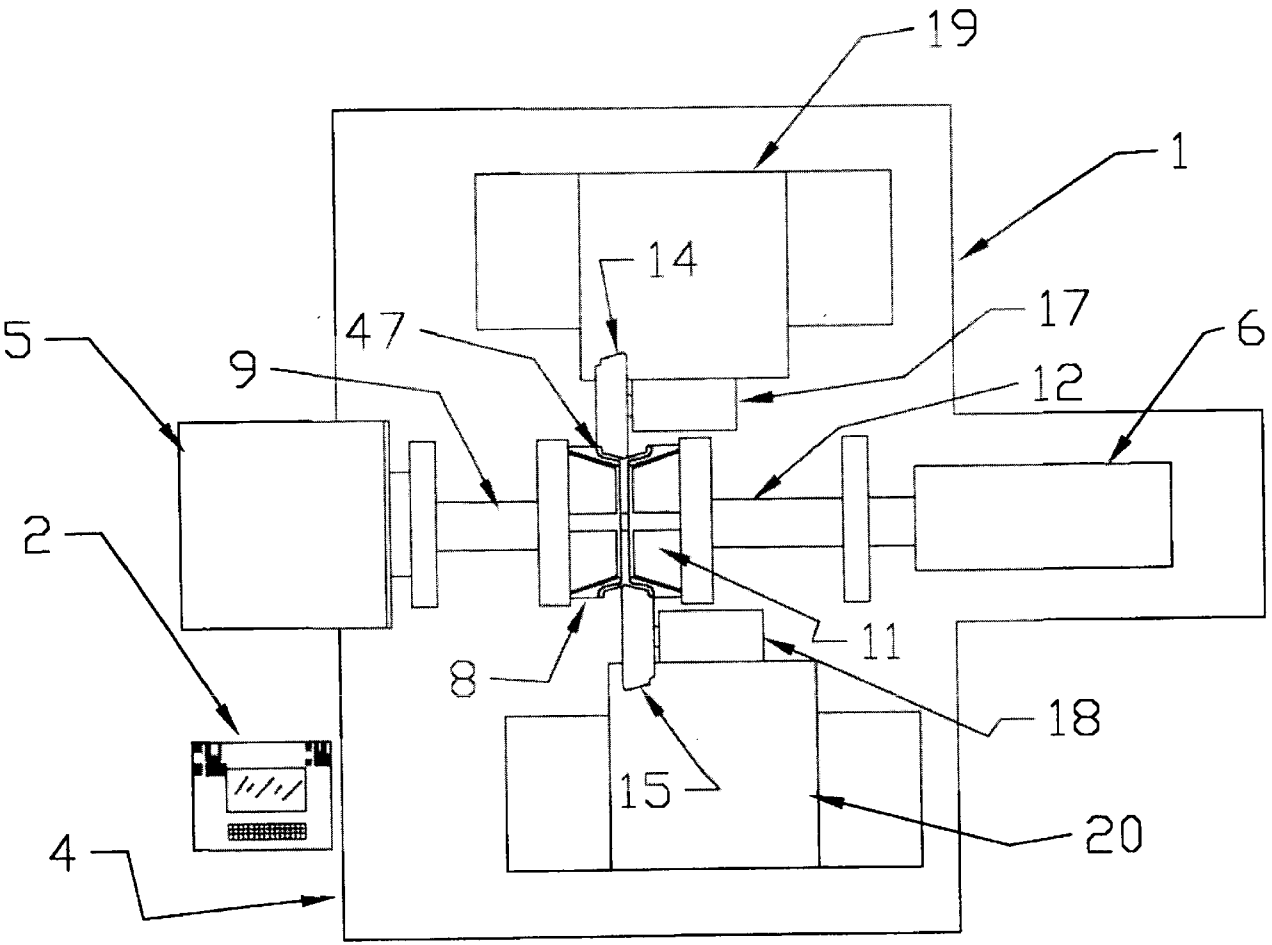
FIG. 1 is an overall diagrammatic layout of a rotary forging and quenching apparatus of the present invention.

Referring now to the drawings, the reference numeral 1, FIG. 1, generally indicates a rotary forging and quenching apparatus according to the present invention. The arrangement of the machine is generally shown and includes a CNC (computer numerically controlled) controller 2 which controls the operation of the machine parts hereinafter described. The CNC controller 2 acts on a machine 4 which includes headstock and tailstock motors 5 and 6 driving a headstock fixture in the form of a mandrel 8 through a headstock coupling 9. The tailstock 6 supports a fixture in the form of a tailstock mandrel 11 through a coupling 12. The headstock 5 and tailstock 6 rotate at the same rate so that a part held by the mandrels 8 and 11 is evenly rotated. A part to be rotary forged and held by the mandrels 8 and 11 is formed by at least one full contour roller. Upper and lower contour rollers 14 and 15 are shown in FIG. 1. Each of these rollers 14 and 15 covers a little over one-half of the area to be rotary forged on the selected part, but in combination, covers the full part contour. Each of the rollers 14 and 15 is powered by respective motors 17 and 18 and is mounted to appropriate slide mechanisms 19 and 20 for back and forth movement as the part is rotary forged.

Figure 2:
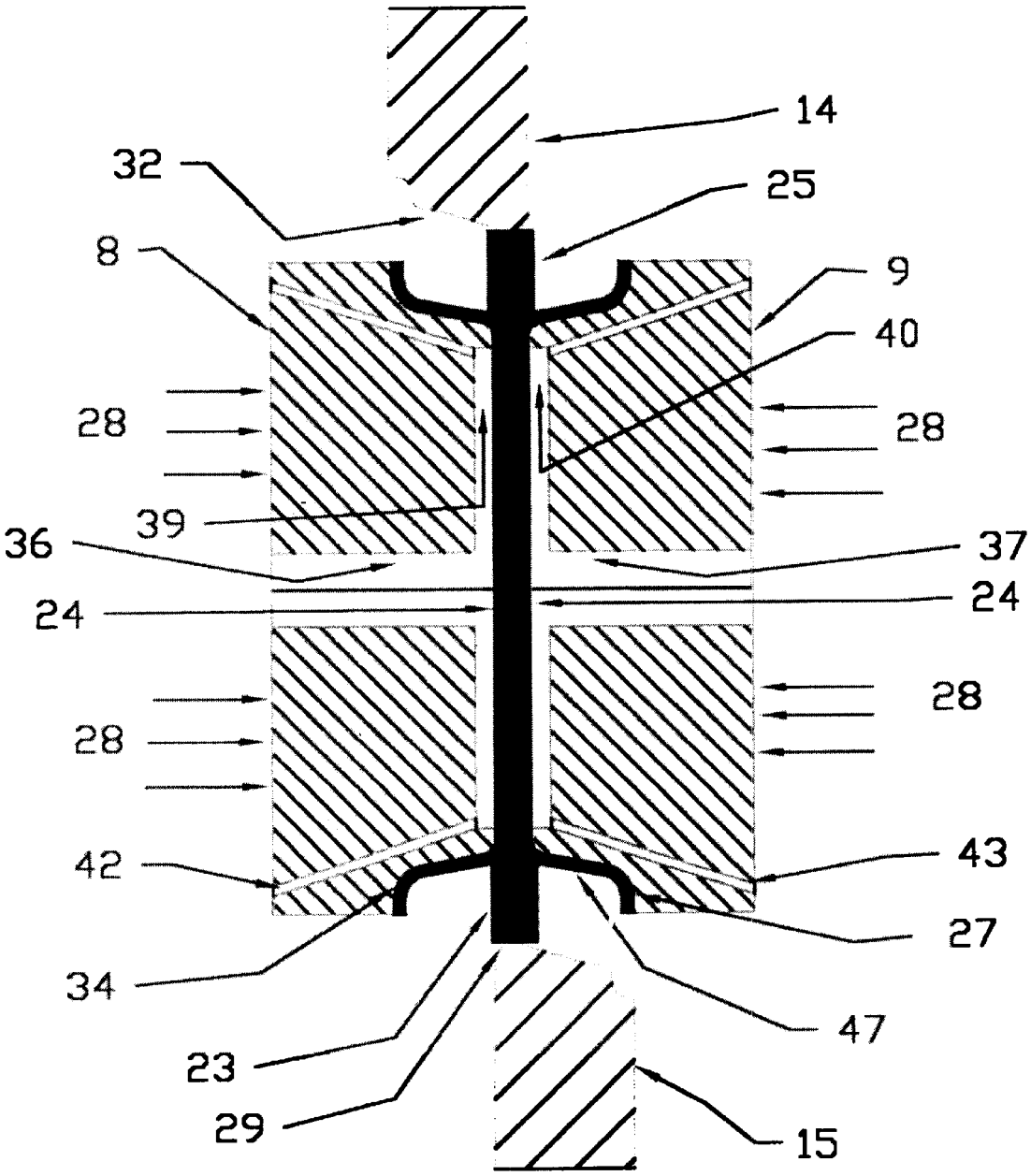
FIG. 2 is a generalized cross-sectional view of fixture mandrels constraining a preform billet and with contour rollers bearing against the billet periphery.

Further details of the fixturing parts are shown in connection with FIG. 2. FIG. 2 shows a billet 23 which has been preformed by stamping, forging, machining or other similar process. The billet 23, in the illustrated example, is particularly adapted for forming into an automobile or motorcycle wheel and has a center web 24 and a thickened circumferential periphery 25. The center web 24 is clamped between the headstock and tailstock mandrels 8 and 9. FIG. 2 shows a cross-section of the preformed billet 23 held in position by the mandrels 8 and 9, which include rim engagement portions 27. Left and right rim engagement portions 27 engage the center web adjacent the billet periphery 25 and provide support thereto as the thickened periphery engages the contour rollers 14 and 15. FIG. 2 shows the contour rollers as having tooling tips 29 which bear down upon the periphery 25. Each contour roller 14 and 15 include a roller surface shape 32 which corresponds to and mates with the desired outside wheel rim shape 47. The fixture surface shape 34 in the mandrels 8 and 9 forms the inside wheel rim shape. Thus, it will be seen that as the mandrels 8 and 9 clamp down with forces 28 upon the preformed billet 23 and rotate, the contour rollers 14 and 15 bear down upon the billet periphery 25 with significant force and cause the rotary forging formable material, such as aluminum, to be spun between the roller surface shape 32 and the fixture surface shape 34 to conform to the desired shape 47. The contour rollers 14 and 15, FIG. 2, are positioned to slightly overlap for a smooth transition within the dropped surface of the automobile wheel rim to be formed.

Figure 3:
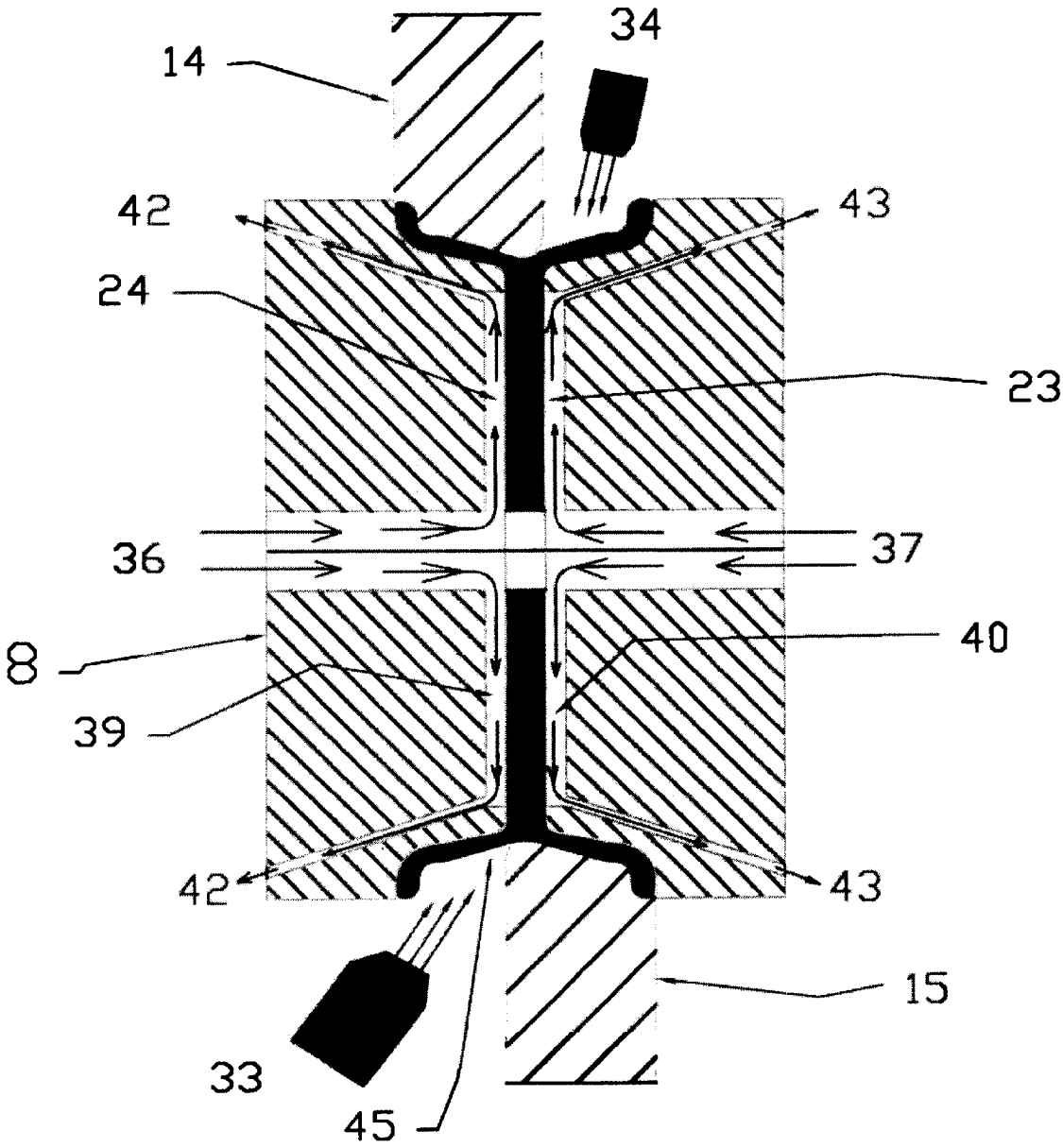
FIG. 3 is a sequential view after FIG. 2 and showing the introduction of coolant into the fixture mandrel and around the contour rollers.

The preformed billet 23 is, for example, 6061 aluminum alloy and is heated to approximately 840 to 1075° F. in a furnace, from where it is rapidly taken to the forming machine 1 and clamped between the mandrels 8 and 9. The mandrels 8 and 9 and the contour rollers 14 and 15 are particularly configured to the desired shape of the spun part. Because the aluminum preformed billet 23 is subjected to considerable temperatures and is clamped hot between the mandrels 8 and 9, and considerable heat is created as the aluminum is squeezed between the rollers and the fixture surface, heat buildup in the billet 23 is significant, which would otherwise cause the part to warp, sag or otherwise deform. To dissipate the heat and to create the desired temper, such as a T6 temper in the 6061 aluminum wheel, the part is quenched while being rotary formed. The mandrels 8 and 9 include coaxial center passageways 36 and 37, an interior channel 39 and 40 adjacent the center web 24, and outflow channels 42 and 43. The outflow channels 42 and 43 are adjacent the outer periphery of the mandrels 8 and 9. As shown in FIG. 3, quench water enters the mandrels through the center passages 36 and 37, circulates through the channels 39 and 40 adjacent opposite faces of the billet center web 24 and exits through the outflow channels 42 and 43. To maximize and produce a consistent quench rate, the coolant is circulated through a heat exchanger to keep the water temperature below 110° F. At the same time, the wheel rim 45 is flooded with coolant by nozzles 38 to dissipate heat therefrom. The quench flooding occurs while the rotors 14 and 15 are working the billet periphery 25 to form the wheel rim 45. This quenching while forming is a rapid process and results in a part with no or minimal distortion or warping due to the heat of rotary forging.

Figure 4:
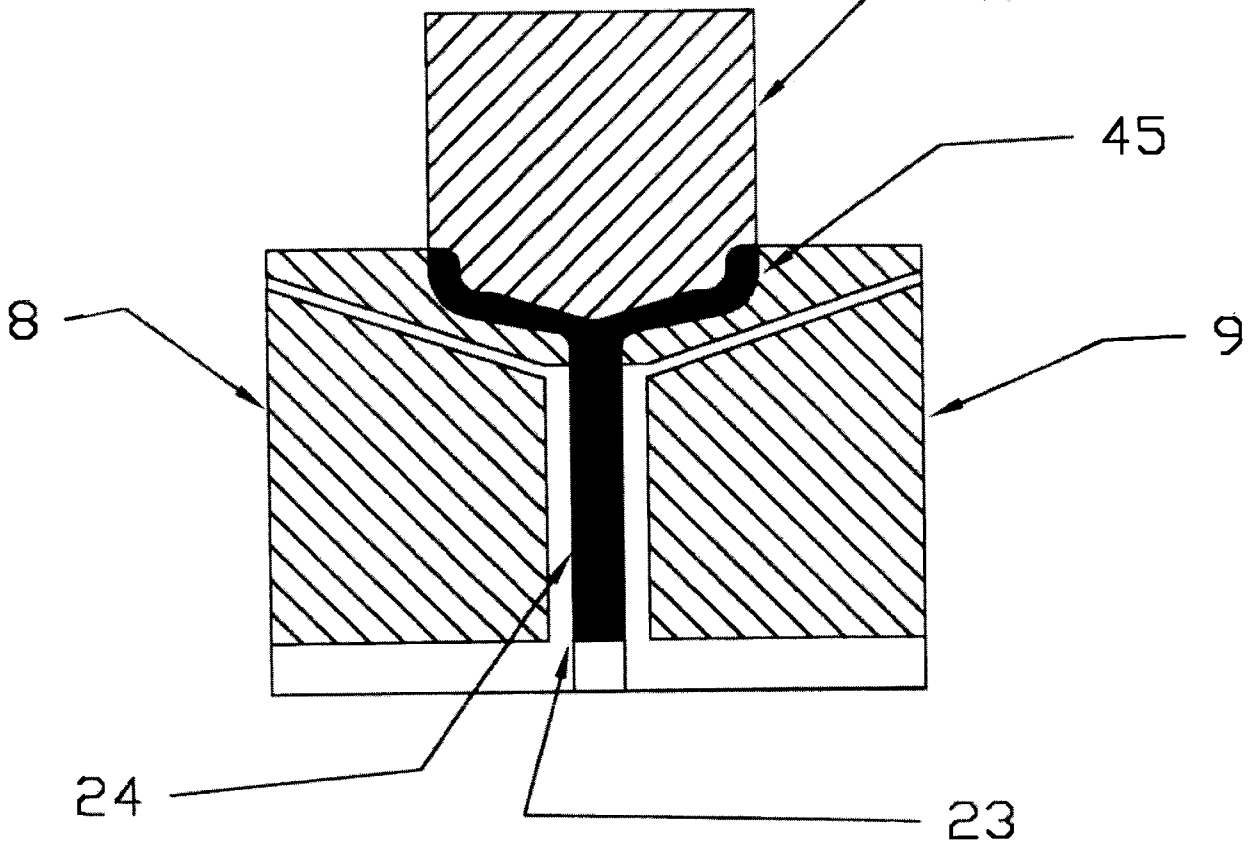
FIG. 4 is a fragmentary view showing the use of a single contour roller.

FIG. 4 illustrates and alternative embodiment wherein, instead of having upper and lower rollers 14 and 15 as shown in FIGS. 1 through 3, a single roller 45 is used. The single roller is substantially like the contour rollers 14 and 15 and is more suited for certain applications, typically narrow applications where one roller can address the full contour. Multiple rollers become necessary to cover the full contour as the wheel width increases.

Figure 5:
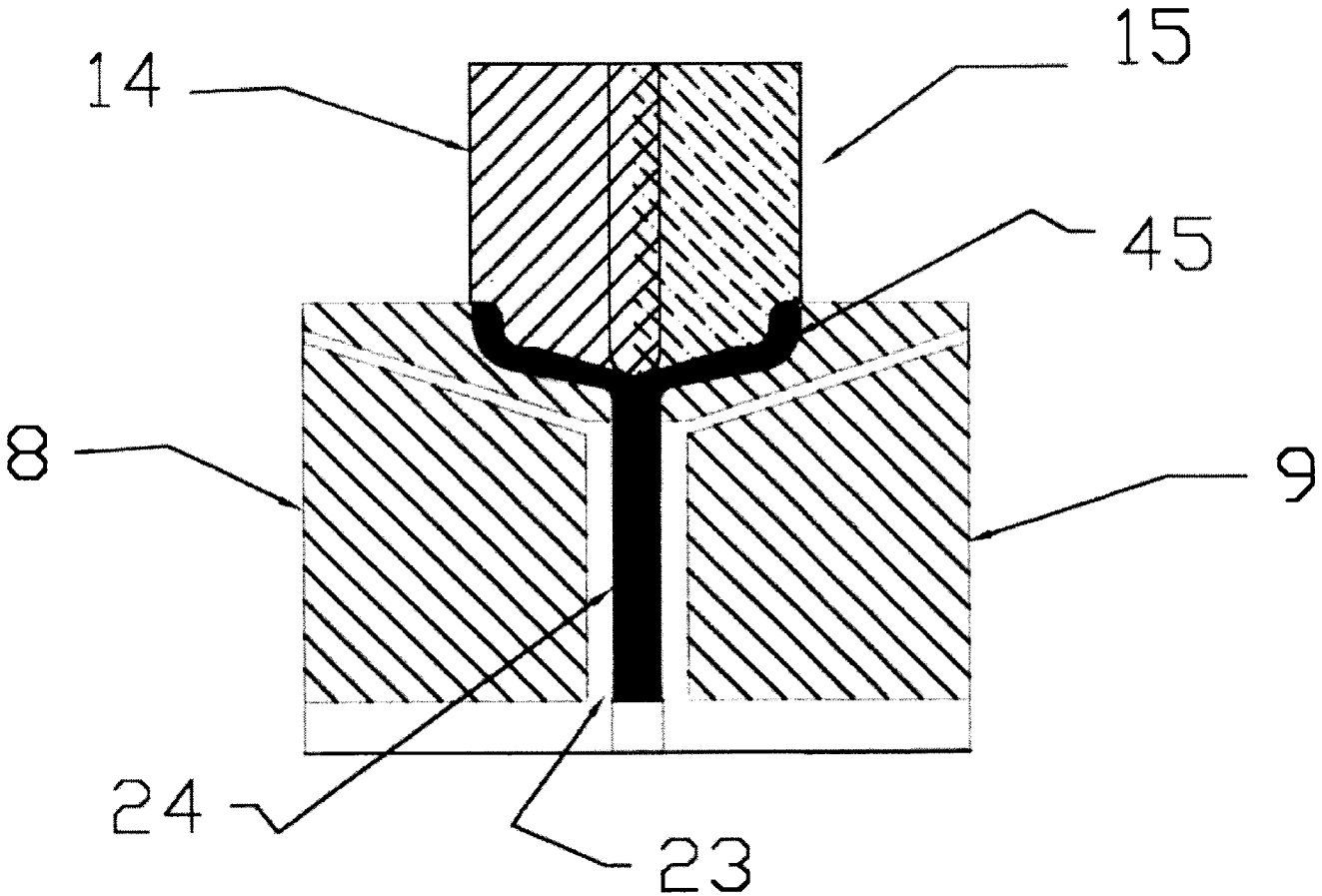
FIG. 5 is an alternative view showing the use of two contour rollers.

FIG. 5 demonstrates the embodiments shown in FIGS. 1 through 3, except that the upper and lower contour rollers 14 and 15 are shown, for purposes of illustration only, rotated so that they are in the same plane and to illustrate the overlap of the rollers 14 and 15.

Figure 6:
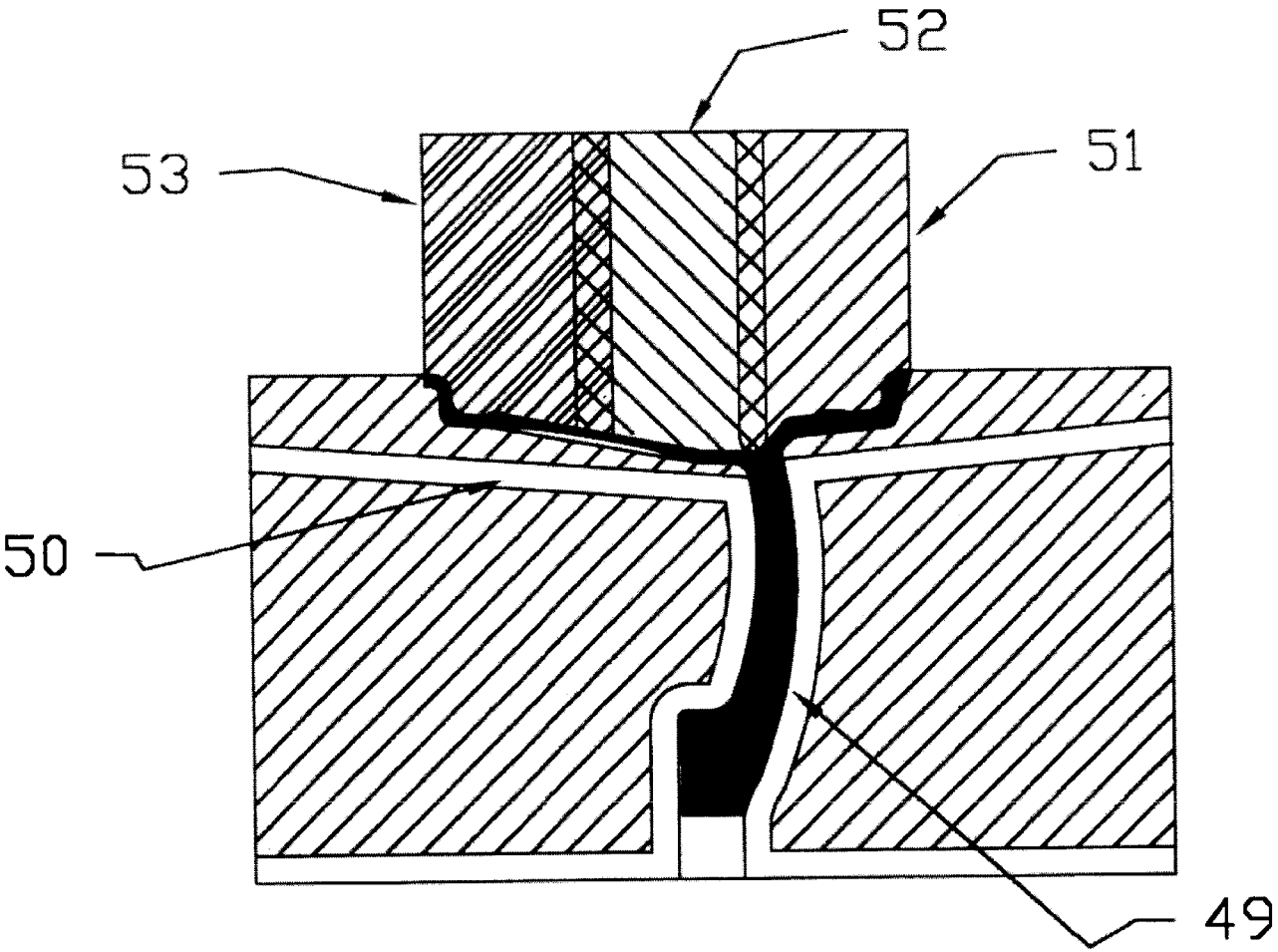
FIG. 6 is an alternative view showing the use of three contour rollers.

FIG. 6 illustrates a wheel, such as a truck wheel 49, having a particularly wide rim 50 which is formed by three rollers, 51, 52 and 53, with an overlap between each of the rollers. The overlap is shown conceptually in FIG. 6, although it will be appreciated that the rollers 51, 52 and 53 are spaced angularly about the periphery of the billet, such as 120 degrees apart, so that the wheel is adequately formed.

By the use of the present invention, a hot billet is rapidly transferred to the rotary forming and quenching machine, formed and cooled during the quenching phase of a standard heat treatment process. The inside of the fixture mandrels directs coolant on the wheel center, cooling the center as the fixure is started rotating. The contact rollers, one, two or multiple rollers, rapidly form the hot periphery of the part into the rim contour. As the metal is formed for the rim contour, the cool fixture and coolant sprayed upon the exterior of the rim rapidly cool the rim to complete the rotary quench process. The cooling water is circulated through a heat exchanger and cooling tower to keep the water temperature below 110° F. to maximize the water's cooling capacity.

Because this forming and quenching process is done on a mandrel, it substantially eliminates any quench distortion. The wheel center is constrained during the cooling process by the mandrel. This rapid CNC-controlled sequential cooling and forming action produces an effective heat treat quenching process. The elimination of heat treat distortion allows parts to be produced nearer to final dimensions and produces a beneficial stress condition in the finished part. The process results in lower material and machining costs and produces a longer lasting higher quality wheel or other spun part.

An application for the rotary forming and quenching process is the production of aluminum wheels of 6061 allow with T6 heat treatment. This process is applicable to many round parts and aluminum alloys that require the solution treat, quench and aging heat treatment process.

What is claimed and desired to be secured by Letters Patent is:

1. A method of forming a vehicle wheel from a perform shape of spin formable material having a center web and a thickened periphery, wherein said wheel includes a rim having in cross-section a drop center, generally axial integral flanges extending in opposite directions therefrom, a generally radial tire bead retaining flange extending from the outside of each of said axial flanges, and a wheel center joining said rim adjacent the axially outer portion of said rim, said method comprising the steps of:

a) solution heat treating said preform shape to a working temperature;

b) quickly positioning and clamping said preform shape while still hot between opposed headstock fixtures having a circumferential die shape and which have quench solution channels running there through;

c) rapidly spinning said headstock fixtures and said hot preform shape and bringing at least one contour roller of a mating circumferential die shape to bear against the material periphery in order to spin shape said material into the circumferential die shape; and d) flooding said material with a quench solution coolant while being spin-formed, said coolant being directed through said headstock fixtures quench solution channels and contacting said center web and simultaneously flooding said material periphery as said material is being spin-forged, thereby producing full heat treatment properties in said vehicle wheel.

2. The method set forth in claim 1 wherein there are two said contour rollers, each corresponding to approximately half of a combined circumferential die shape, with said quench solution coolant flooding the circumferential periphery of said preform shape in an area unoccupied by said contour rollers.

3. The method set forth in claim 1 wherein said headstock fixtures have axial inflow channels for said quench solution coolant and radial channels in surface contact with preform shape center web, with exit channels adjacent said periphery.

4. A method of forming a cylindrical object from a preform shape of spin formable material having a center web and a thickened periphery, wherein said cylindrical object includes a center section and a peripheral margin, said method comprising the steps of:

a) heating said preform shape to a working temperature;

b) quickly positioning and clamping said hot preform shape between opposed headstock fixtures having a circumferential die shape and which have quench solution channels running there through;

c) rapidly spinning said headstock fixtures and said hot preform shape and bringing at least one contour roller of a mating circumferential die shape to bear against the material peripheral margin in order to spin shape the material into the circumferential die shape; and d) flooding said material with a quench solution coolant while being spin-formed, said coolant being directed through said headstock fixtures quench solution channels and contacting said preform shape center section and simultaneously flooding said periphery as said material is being rotary spin-forged, thereby producing full heat treatment properties in said cylindrical object.

5. A rotary spin forging machine for making a product from a heated, cylindrical preform shape of spin forging formable material wherein said preform shape includes a center section and a peripheral margin, said machine comprising:

a) opposed headstock fixtures movable to clamp said preform shape between them and having quench solution channels running there through, said headstock fixtures having a forming die rim;

b) at least one contour roller of a mating forming die shape and which bears against the headstock fixtures forming die rim to spin-form material there between; and c) means for providing quench solution coolant into the headstock fixtures channels and into intimate contact with said heated preform shape and means for flooding said coolant about said contour roller as said headstock fixtures spin.

* * * * *